US007008968B2

(12) United States Patent
Font Freide et al.

(10) Patent No.: US 7,008,968 B2
(45) Date of Patent: Mar. 7, 2006

(54) FISCHER-TROPSCH PROCESS

(75) Inventors: Josephus Johannes Helena Maria Font Freide, Surrey (GB); Barry Nay, Surrey (GB); Christopher Sharp, East Yorkshire (GB)

(73) Assignees: BP Exploration Operation Company Limited, London (GB); Davy Process Technology Limited, London (GB)

( * ) Notice: Subject to any disclaimer, the term of this patent is extended or adjusted under 35 U.S.C. 154(b) by 90 days.

(21) Appl. No.: 10/476,526

(22) PCT Filed: May 17, 2002

(86) PCT No.: PCT/GB02/02328

§ 371 (c)(1),
(2), (4) Date: Oct. 31, 2003

(87) PCT Pub. No.: WO02/097011

PCT Pub. Date: Dec. 5, 2002

(65) Prior Publication Data

US 2004/0147622 A1 Jul. 29, 2004

(30) Foreign Application Priority Data

May 25, 2001 (GB) ..... 0112794

(51) Int. Cl.
*C07C 27/00* (2006.01)

(52) U.S. Cl. ..... 518/709; 518/700; 518/705; 518/715

(58) Field of Classification Search ..... 518/709, 518/700, 715
See application file for complete search history.

(56) References Cited

FOREIGN PATENT DOCUMENTS

| | | |
|---|---|---|
| EP | 0 533 227 A1 | 3/1993 |
| GB | 728 543 A | 4/1955 |
| WO | WO 01/38269 A1 | 5/2001 |

*Primary Examiner*—J. Parsa
(74) *Attorney, Agent, or Firm*—Nixon & Vanderhye

(57) ABSTRACT

Process of contacting a gaseous reactant stream comprising synthesis gas at elevated temperature and pressure with a suspension of a particulate Fischer-Tropsch catalyst comprising cobalt in a liquid medium in a reactor system comprising at least one high shear mixing zone and a reactor vessel, by a) contacting the particulate Fischer-Tropsch catalyst with a reducing gas at elevated temperature and pressure outside of the high shear mixing zone(s) and the reactor vessel and subsequently suspending the particulate Fischer-Tropsch catalyst in the liquid medium; b) passing the suspension from step a) through the high shear mixing zone(s) where the gaseous reactant stream comprising synthesis gas is mixed with the suspension; c) discharging a mixture comprising the synthesis gas and the suspension from the high shear mixing zone(s) into the reactor vessel; and d) converting the synthesis gas to liquid hydrocarbons in the reactor vessel to form a product suspension comprising the particulate Fischer-Tropsch catalyst suspended in the liquid medium and liquid hydrocarbons.

27 Claims, No Drawings

FISCHER-TROPSCH PROCESS

This application is the U.S. National Phase of International Application PCT/GB02/02328, filed 17 May 2002, which designated the U.S.

The present invention relates to a process for the conversion of carbon monoxide and hydrogen (synthesis gas) to liquid hydrocarbon products in the presence of a particulate catalyst.

BACKGROUND OF THE INVENTION

In the Fischer-Tropsch reaction synthesis gas is reacted in the presence of a heterogeneous catalyst to give a hydrocarbon mixture having a relatively broad molecular weight distribution. This product comprises predominantly straight chain saturated hydrocarbons which typically have a chain length of more than 5 carbon atoms. The reaction is highly exothermic and therefore heat removal is one of the primary constraints of all Fischer-Tropsch processes.

It has recently been found that a Fischer-Tropsch process may be operated by contacting synthesis gas with a suspension of a catalyst in a liquid medium in a system comprising at least one high shear mixing zone and a reactor vessel. This process is described in WO 0138269 (PCT patent application number GB 0004444) which is herein incorporated by reference. It has now been found that a Fischer-Tropsch catalyst comprising cobalt can be treated with a reducing gas to provide a highly active catalyst with increased selectivity to liquid hydrocarbons.

DESCRIPTION OF THE INVENTION

Accordingly the invention provides a process which comprises contacting a gaseous reactant stream comprising synthesis gas at elevated temperature and pressure with a suspension of a particulate Fischer-Tropsch catalyst comprising cobalt in a liquid medium in a reactor system comprising at least one high shear mixing zone and a reactor vessel wherein the process comprises:

a) contacting the particulate Fischer-Tropsch catalyst with a reducing gas at elevated temperature and pressure outside of the high shear mixing zone(s) and the reactor vessel and subsequently suspending the particulate Fischer-Tropsch catalyst in the liquid medium;

b) passing the suspension from step a) through the high shear mixing zone(s) where the gaseous reactant stream comprising synthesis gas is mixed with the suspension;

c) discharging a mixture comprising the synthesis gas and the suspension from the high shear mixing zone(s) into the reactor vessel; and d) converting the synthesis gas to liquid hydrocarbons in the reactor vessel to form a product suspension comprising the particulate Fischer-Tropsch catalyst suspended in the liquid medium and liquid hydrocarbons.

The particulate Fischer-Tropsch catalyst which is contacted with a reducing gas in step (a) may be a fresh catalyst comprising a cobalt oxide precursor, a partially deactivated catalyst or a completely deactivated catalyst. A partially deactivated catalyst is a catalyst that has lost up to 20% of its original activity.

The catalyst is preferably contacted with the reducing gas at a temperature of 50–600° C. and especially at a temperature of 100–450° C. Preferably the catalyst is contacted with the reducing gas at a pressure of 1–100 bar, and especially at a pressure of 1–10 bar.

Usually the reducing gas comprises hydrogen and/or carbon monoxide.

Generally prior to contacting the catalyst with the reducing gas the catalyst is treated with an inert gas selected from helium, argon or nitrogen, preferably nitrogen. Usually the catalyst is also post treated with the inert gas prior to suspending the catalyst in the liquid medium. The catalyst may be contacted sequentially with carbon monoxide and hydrogen. Advantageously, the catalyst is contacted with carbon monoxide followed by the inert gas and finally hydrogen.

Contacting a fresh catalyst comprising a cobalt oxide precursor or a partially deactivated catalyst with the reducing gas as herein described above provides a catalyst which is highly active in the Fischer-Tropsch reaction and which has an improved selectivity to liquid hydrocarbon products.

Preferably, when treating a completely deactivated catalyst, the catalyst is contacted with an oxidizing gas prior to being contacted with the reducing gas. Suitably, the oxidizing gas comprises 1–10% oxygen and 99–90% inert gas e.g. helium, argon or nitrogen. Preferably, the completely deactivated catalyst is treated sequentially with an oxidizing gas, an inert gas, and finally the reducing gas.

Preferably the completely deactivated catalyst may be contacted with the inert gas at a temperature of 50–400° C. and especially at a temperature of 200–300° C. Preferably the completely deactivated catalyst is contacted with the inert gas at a pressure of 1–100 bar, and especially at a pressure of 1–10 bar.

The completely deactivated catalyst may then be contacted with an oxidizing gas at a temperature of 300–600° C. and especially at a temperature of 350–450° C. Preferably the completely deactivated catalyst is contacted with the oxidizing gas at a pressure of 1–100 bar, and especially at a pressure of 1–100 bar. This treatment oxidizes the carbonaceous deposits located on the catalyst surface and oxidizes the cobalt to form cobalt oxide.

Finally, the completely deactivated catalyst may be contacted with the reducing gas as herein described above to provide a catalyst which is highly active in the Fischer-Tropsch reaction and has an improved selectivity to liquid hydrocarbon products.

Generally, the catalyst may be contacted with the reducing gas in a fixed or fluidized bed reactor or a slurry reactor. Preferably when a fresh catalyst comprising a cobalt oxide precursor is being activated or a completely deactivated catalyst is being regenerated the reducing gas is contacted with the catalyst in a fluidized bed reactor prior to suspending the catalyst in the liquid medium.

Alternatively, when a partially deactivated catalyst is being rejuvenated the reducing gas is contacted with the catalyst in a reactor system comprising at least one high shear mixing zone and a reactor vessel as described in WO 0138269 (PCT patent application number GB 0004444) wherein the partially deactivated catalyst remains in suspension owing to the mechanical energy imparted to the suspension by the high shear mixing zone(s).

Accordingly, in a further embodiment of the present invention there is provided a process for rejuvenating a partially deactivated catalyst which has been partially deactivated in step (d) by contacting a suspension comprising the partially deactivated catalyst suspended in a liquid medium with a reducing gas in a reactor system comprising at least one high shear mixing zone and a reactor vessel wherein the process comprises:

a) passing the suspension through the high shear mixing zone(s) where the reducing gas is mixed with the suspension;

b) discharging a mixture comprising the reducing gas and the suspension from the high shear mixing zone(s) into the reactor vessel; and c) recycling the suspension to the high shear mixing zone(s).

Preferably, the liquid medium is a liquid hydrocarbon. Preferably, the partially deactivated catalyst is rejuvenated by contacting the suspension sequentially with carbon monoxide and hydrogen. The partially deactivated catalyst is preferably contacted with the reducing gas at a temperature of 50–600° C. and especially at a temperature of 100–450° C. Preferably the catalyst is contacted with the reducing gas at a pressure of 1–100 bar, and especially at a pressure of 1–10 bar.

Preferably, prior to the rejuvenation process, synthesis gas is fed to the high shear mixing zone(s) and is converted to hydrocarbons by contact with the catalyst in the reactor system. Similarly, after completion of the rejuvenation process, synthesis gas is fed to the high shear mixing zone(s).

Preferably, when a fresh catalyst has been activated, a completely deactivated catalyst has been regenerated or a partially deactivated catalyst has been rejuvenated as herein described above a suspension of the catalyst is passed through the high shear mixing zone(s) and mixed with synthesis gas as described in WO 0138269 (PCT patent application number GB 0004444).

The reactor vessel may be a tank reactor or a tubular loop reactor.

The high shear mixing zone(s) may be part of the reactor system inside or outside the reactor vessel, for example, the high shear mixing zone(s) may project through the walls of the reactor vessel such that the high shear mixing zone(s) discharges its contents into the reactor vessel. Preferably, the reactor system comprises up to 250 high shear mixing zones, more preferably less than 100, most preferably less than 50, for example 10 to 50 high shear mixing zones. Preferably, the high shear mixing zones discharge into or are located within a single reactor vessel as described in WO 0138269 (PCT patent application number GB 0004444). It is also envisaged that 2 or 3 such reactor systems may be employed in series.

Suitably, the volume of suspension present in the high shear mixing zone(s) is substantially less than the volume of suspension present in the reactor vessel, for example, less than 20%, preferably less than 10% of the volume of suspension present in the reactor vessel.

The high shear mixing zone(s) may comprise any device suitable for intensive mixing or dispersing of a gaseous stream in a suspension of solids in a liquid medium, for example, a rotor-stator device, an injector-mixing nozzle or a high shear pumping means, but is preferably an injector mixing nozzle(s). Suitably, the device is capable of breaking down the gaseous stream into gas bubbles and/or irregularly shaped gas voids.

The kinetic energy dissipation rate in the high shear mixing zone(s) is suitably, at least 0.5 $kW/m^3$ relative to the total volume of suspension present in the system, preferably in the range 0.5 to 25 $kW/m^3$, more preferably 0.5 to 10 $kW/m^3$, most preferably 0.5 to 5 $kW/m^3$, and in particular, 0.5 to 2.5 $kW/m^3$ relative to the total volume of suspension present in the system.

Where the high shear mixing nozzles comprise an injector mixing nozzle(s) the injector-mixing nozzle(s) can advantageously be executed as a venturi tube (c.f. "Chemical Engineers' Handbook" by J. H. Perry, $3^{rd}$ edition (1953), p.1285, FIG. 61), preferably an injector mixer (c.f. "Chemical Engineers' Handbook" by J H Perry, $3^{rd}$ edition (1953), p 1203, FIG. 2 and "Chemical Engineers' Handbook" by R H Perry and C H Chilton $5^{th}$ edition (1973) p 6–15, FIGS. 6–31) or most preferably as a liquid-jet ejector (cf. "Unit Operations" by G G Brown et al, $4^{th}$ edition (1953), p.194, FIG. 210). The injector mixing nozzle(s) may also be executed as a venturi plate positioned within an open ended conduit which discharges the mixture of synthesis gas and suspension into a tank reactor. Alternatively the venturi plate may be positioned within a tubular loop reactor. Suitably, synthesis gas is introduced into the open-ended conduit or tubular loop reactor downstream of the venturi plate. The injector-mixing nozzle(s) may also be executed as "gas blast" or "gas assist" nozzles where gas expansion is used to drive the nozzle (c.f. "Atomisation and Sprays" by Arthur H Lefebvre, Hemisphere Publishing Corporation, 1989). Where the injector-mixing nozzle(s) is executed as a "gas blast" or "gas assist" nozzle, the suspension of catalyst is fed to the nozzle at a sufficiently high pressure to allow the suspension to pass through the nozzle while the gaseous reactant stream is fed to the nozzle at a sufficiently high pressure to achieve high shear mixing within the nozzle.

The high shear mixing zone(s) may also comprise a high shear pumping means, for example, a paddle or propeller having high shear blades positioned within an open ended pipe which discharges the mixture of synthesis gas and suspension into the reactor vessel. Preferably, the high shear pumping means is located at or near the open end of the pipe, for example, within 1 meter preferably within 0.5 meters of the open end of the pipe. Alternatively, the high shear pumping means may be positioned within a tubular loop reactor vessel. Synthesis gas may be injected into the pipe or tubular loop reactor vessel, for example, via a sparger, located immediately upstream or downstream, preferably upstream of the high shear pumping means, for example, preferably, within 1 meter, preferably within 0.5 meter of the high shear pumping means. Without wishing to be bound by any theory, the injected synthesis gas is broken down into gas bubbles and/or irregularly shaped gas voids by the fluid shear imparted to the suspension by the high shear pumping means.

Where the injector mixing nozzle(s) is executed as a venturi nozzle(s) (either a conventional venturi nozzle or as a venturi plate), the pressure drop of the suspension over the venturi nozzle(s) is typically in the range of from 1 to 40 bar, preferably 2 to 15 bar, more preferably 3 to 7 bar, most preferably 3 to 4 bar. Preferably, the ratio of the volume of gas ($Q_g$) to the volume of liquid ($Q_l$) passing through the venturi nozzle(s) is in the range 0.5:1 to 10:1, more preferably 1:1 to 5:1, most preferably 1:1 to 2.5:1, for example, 1:1 to 1.5:1 (where the ratio of the volume of gas ($Q_g$) to the volume of liquid ($Q_l$) is determined at the desired reaction temperature and pressure).

Where the injector mixing nozzle(s) is executed as a gas blast or gas assist nozzle(s), the pressure drop of gas over the nozzle(s) is preferably in the range 3 to 100 bar and the pressure drop of suspension over the nozzle(s) is preferably in the range of from 1 to 40 bar, preferably 4 to 15, most preferably 4 to 7. Preferably, the ratio of the volume of gas ($Q_g$) to the volume of liquid ($Q_l$) passing through the gas blast or gas assist nozzle(s) is in the range 0.5:1 to 50:1, preferably 1:1 to 10:1 (where the ratio of the volume of gas ($Q_g$) to the volume of liquid ($Q_l$) is determined at the desired reaction temperature and pressure).

Suitably, the shearing forces exerted on the suspension in the high shear mixing zone(s) are sufficiently high that the synthesis gas is broken down into gas bubbles having diameters in the range of from 1 μm to 10 mm, preferably from 30 μm to 3000 μm, more preferably from 30 μm to 300 μm.

Without wishing to be bound by any theory, it is believed that the irregularly shaped gas voids are transient in that they are coalescing and fragmenting on a time scale of up to 500 ms, for example, over a 10 to 50 ms time scale. The irregularly shaped gas voids have a wide size distribution with smaller gas voids having an average diameter of 1 to 2 mm and larger gas voids having an average diameter of 10 to 15 mm.

The high shear mixing zone(s) can be placed at any position on the walls of the reactor vessel (for example, at the top, bottom or side walls of a tank reactor). Where the reactor vessel is a tank reactor the suspension is preferably withdrawn from the reactor vessel and is at least in part recycled to a high shear mixing zone(s) through an external conduit having a first end in communication with an outlet for suspension in the reactor vessel and a second end in communication with an inlet of the high shear mixing zone. The suspension may be recycled to the high shear mixing zone(s) via a mechanical pumping means, for example, a slurry pump, positioned in the external conduit. Owing to the exothermic nature of the Fischer-Tropsch synthesis reaction, the suspension recycle stream is preferably cooled by means of a heat exchanger positioned on the external conduit (external heat exchanger). Additional cooling may be provided by means of an internal heat exchanger comprising cooling coils, tubes or plates positioned within the suspension in the tank reactor.

Suitably, the ratio of the volume of the external conduit (excluding the volume of any external heat exchanger) to the volume of the tank reactor is in the range of 0.005:1 to 0.2:1.

Where the reactor vessel is a tubular loop reactor, a single high shear mixing zone, in particular an injector-mixing nozzle may discharge the mixture comprising synthesis gas and the suspension into the tubular loop reactor. Alternatively, a series of injector-mixing nozzles may be arranged around the tubular loop reactor. If necessary, suspension may be circulated around the tubular loop reactor via at least one mechanical pumping means e.g. a paddle or propeller. An external heat exchanger may be disposed along at least part of the tubular loop reactor, preferably along substantially the entire length of the tubular loop reactor thereby providing temperature control. It is also envisaged that an internal heat exchanger, for example cooling coils, tubes or plates may be located in at least part of the tubular loop reactor.

Preferably the Fischer-Tropsch synthesis reaction or the rejuvenation in suspension of the partially deactivated catalyst is operated with a gas hourly space velocity (GHSV) in the range of 100 to 40000 $h^{-1}$, more preferably 1000 to 30000 $h^{-1}$, most preferably 2000 to 15000, for example 4000 to 10000 $h^{-1}$ at normal temperature and pressure (NTP) based on the feed volume of synthesis gas at NTP.

The Fischer-Tropsch process of the invention is preferably carried out at a temperature of 180–280° C., more preferably 190–240° C.

The Fischer-Tropsch process of the invention is preferably carried out at a pressure of 5–50 bar, more preferably 15–35 bar, generally 20–30 bar.

The synthesis gas may be prepared using any of the processes known in the art including partial oxidation of hydrocarbons, steam reforming, gas heated reforming, microchannel reforming (as described in, for example, U.S. Pat. No. 6,284,217 which is herein incorporated by reference), plasma reforming, autothermal reforming and any combination thereof. A discussion of these synthesis gas production technologies is provided in "Hydrocarbon Processing" V78, N.4, 87–90, 92–93 (April 1999) and "Petrole et Techniques", N. 415, 86–93 (July-August 1998). It is also envisaged that the synthesis gas may be obtained by catalytic partial oxidation of hydrocarbons in a microstructured reactor as exemplified in "IMRET 3: Proceedings of the Third International Conference on Microreaction Technology", Editor W Ehrfeld, Springer Verlag, 1999, pages 187–196. Alternatively, the synthesis gas may be obtained by short contact time catalytic partial oxidation of hydrocarbonaceous feedstocks as described in EP 0303438. Preferably, the synthesis gas is obtained via a "Compact Reformer" process as described in "Hydrocarbon Engineering", 2000, 5, (5), 67–69; "Hydrocarbon Processing", 79/9, 34 (September 2000); "Today's Refinery", 15/8, 9 (August 2000); WO 99/02254; and WO 200023689.

Preferably, a stream comprising a coolant liquid, e.g. a low boiling hydrocarbon(s) (for example, methanol, dimethyl ether, pentanes, hexanes or hexenes) may be introduced into the high shear mixing zone(s) and/or the reactor vessel (tank or tubular loop reactor) as described in WO 0138269 (PCT patent application number GB 0004444). Where the reactor vessel is a tank reactor the coolant liquid may also be introduced into the external conduit.

Preferably, the ratio of hydrogen to carbon monoxide in the synthesis gas is in the range of 20:1 to 0.1:1 by volume and especially in the range of 5:1 to 1:1 by volume e.g. 2:1 by volume.

Preferably, the hydrocarbons produced by contact of the synthesis gas with the Fischer-Tropsch catalyst comprise a mixture of hydrocarbons having a chain length of greater than 5 carbon atoms. Suitably, the hydrocarbons comprise a mixture of hydrocarbons having chain lengths of from 5 to about 90 carbon atoms. Preferably, a major amount, for example, greater than 60% by weight, of the hydrocarbons have chain lengths of from 5 to 30 carbon atoms.

The cobalt catalyst employed in the process of the present invention may be supported or unsupported. Preferably the cobalt is supported on an inorganic oxide. Preferred supports include silica, alumina, silica-alumina, the Group IVB oxides, titania (primarily in the rutile form) and preferably zinc oxide. The supports generally have a surface area of less than about 100 $m^2/g$, suitably less than 50 $m^2/g$, for example, less than 25 $m^2/g$ or about 5 $m^2/g$.

Usually at least 0.1% cobalt (by weight of support) is present and preferably about 0.1–20%, and especially 0.5–5 wt %. Promoters may be added to the catalyst and are well known in the Fischer-Trospch catalyst art. Promoters can include ruthenium, platinum or palladium (when not the primary catalyst metal), aluminium, rhenium, hafnium, cerium, lanthanum and zirconium, and are usually present in amounts less than the cobalt (except for ruthenium which may be present in coequal amounts), but the promoter:metal ratio should be at least 1:10. Preferred promoters are rhenium and hafnium.

The particulate Fischer-Tropsch catalyst may have an average particle size in the range 5 to 500 microns, preferably 5 to 100 microns, for example, in the range 5 to 40 microns.

Usually the suspension discharged into the reactor vessel comprises less than 40% by weight of particulate Fischer Tropsch catalyst, more preferably 10 to 30% by weight of particulate Fischer Tropsch catalyst, most preferably 10 to 20% by weight of particulate Fischer Tropsch catalyst.

EXAMPLES

The activation and regeneration of the particulate Fischer-Tropsch catalysts will now be illustrated in the following examples;

Example 1 (Activation)

10 ml of a fresh catalyst comprising a cobalt oxide precursor was placed in a 2.5 cm tubular reactor. The reactor was maintained at a pressure of 1 bar and was purged with air having a GHSV of 1800 $h^{-1}$. The temperature was raised by 1° $C.min^{-1}$ to 250° C. and the reactor was maintained at 250° C. for 30 min. The gas feed was then changed to nitrogen having a GHSV of 1800 $h^{-1}$ for 15 min. The gas feed was then changed to carbon monoxide having a GHSV of 1800 $h^{-1}$ and this was maintained for 3.5 h. The gas feed was changed to nitrogen having a GHSV of 1800 $h^{-1}$ for 15 min. The gas feed was then changed to hydrogen having a GHSV of 800 $h^{-1}$ for a period of 10 h. The reactor was then cooled to room temperature and purged with nitrogen. The activated catalyst was then transferred to the Fischer-Tropsch reactor system under inert gas purge.

Example 2 (Activation)

10 ml of a fresh catalyst comprising a cobalt oxide precursor was placed in a 2.5 cm tubular reactor. The reactor was maintained at a pressure of 1 bar and was purged with hydrogen having a GHSV of 1800 $h^{-1}$ for 1.5 h. The temperature was raised at 1° $C.min^{-1}$ to 260° C. and maintained at 260° C. for 10 h with hydrogen flowing at a GHSV of 1800 $h^{-1}$. The reactor was then cooled to room temperature and purged with nitrogen. The activated catalyst was then transferred to the Fischer-Tropsch reactor system under inert gas purge.

Example 3 (Regeneration)

10 ml of a completely deactivated catalyst was placed in a 2.5 cm tubular reactor. The reactor was maintained at a pressure of 1 bar and was purged with hydrogen having a GHSV of 1800 $h^{-1}$ for 1.5 h. The temperature was raised at 20° $C.min^{-1}$ to 260° C. and maintained at 260° C. for 3 h with hydrogen flowing at a GHSV of 1800 $h^{-1}$. The gas stream was then changed to 1% O2 in N2 having a GHSV of 1800 $h^{-1}$. After 3 h the gas stream was changed to 5% O2 in N2 having a GHSV of 1800 $h^{-1}$. After 1 h the gas stream was changed to air having a GHSV of 1800 $h^{-1}$. After 0.5 h the temperature was raised at 2° $C.min^{-1}$ to 300° C. and maintained at 300° C. for 5 min. The temperature was then raised at 5° $C.min^{-1}$ to 400° C. and maintained at 400° C. for 14.5 h. The reactor was then cooled to 250° C. and the gas stream changed to nitrogen having a GHSV of 1800 $h^{-1}$. After 30 min the gas stream was changed to carbon monoxide having a GHSV of 1800 $h^{-1}$ and after 3 h the gas stream was changed to nitrogen having a GHSV of 1800 $h^{-1}$. After for 30 min the gas stream was then changed to hydrogen having GHSV at 1800 $h^{-1}$ and the temperature was raised at 20° $C.min^{-1}$ to 260° C. After 1 h the reactor was cooled to room temperature and purged with nitrogen. The regenerated catalyst was then transferred to the Fischer-Tropsch reactor system under inert gas purge.

What is claimed is:

1. A process which comprises contacting a gaseous reactant stream comprising synthesis gas at elevated temperature and pressure with a suspension of a particulate Fischer-Tropsch catalyst comprising cobalt in a liquid medium in a reactor system comprising at least one high shear mixing zone and a reactor vessel wherein the process comprises the steps of;

a) contacting the particulate Fischer-Tropsch catalyst with a reducing gas at elevated temperature and pressure outside of the high shear mixing zone(s) and the reactor vessel and subsequently suspending the particulate Fischer-Tropsch catalyst in the liquid medium;

b) passing the suspension from step a) through the high shear mixing zone(s) where the gaseous reactant stream comprising synthesis gas is mixed with the suspension;

c) discharging a mixture comprising the synthesis gas and the suspension from the high shear mixing zone(s) into the reactor vessel; and d) converting the synthesis gas to liquid hydrocarbons in the reactor vessel to form a product suspension comprising the particulate Fischer-Tropsch catalyst suspended in the liquid medium and liquid hydrocarbons.

2. A process according to claim 1 wherein the particulate Fischer-Tropsch catalyst in step (a) is a fresh catalyst comprising a cobalt oxide precursor, a partially deactivated catalyst or a completely deactivated catalyst.

3. A process according to claim 1 wherein the catalyst is contacted with the reducing gas in step (a) at a temperature of between 50–600° C.

4. A process according to claim 1 wherein the catalyst is contacted with the reducing gas at a pressure of 1–100 bar.

5. A process according to claim 1 wherein the reducing gas comprises hydrogen and/or carbon monoxide.

6. A process according to claim 1 wherein prior to contacting the catalyst with the reducing gas in step (a) the catalyst is treated with an inert gas selected from helium, argon or nitrogen.

7. A process according to claim 1 wherein the catalyst is contacted sequentially in step (a) with carbon monoxide followed by the inert gas and finally hydrogen.

8. A process according to claim 1 wherein the catalyst is a completely deactivated catalyst and is contacted in step (a) with an oxidizing gas prior to being contacted with the reducing gas.

9. A process according to claim 8 wherein the oxidizing gas comprises 1–10% oxygen and 99–90% inert gas.

10. A process according to claim 8 wherein the completely deactivated catalyst is treated sequentially with an oxidizing gas, an inert gas and finally the reducing gas.

11. A process according to claim 8 wherein the completely deactivated catalyst is contacted with the inert gas at a temperature of 50–400° C.

12. A process according to claim 8 wherein the completely deactivated catalyst is contacted with the inert gas at a pressure of 1–100 bar.

13. A process according to claim 8 wherein the completely deactivated catalyst is contacted with an oxidizing gas at a temperature of 300–600° C.

14. A process according to claim 8 wherein the completely deactivated catalyst is contacted with an oxidizing gas at a pressure of 1–100 bar.

15. A process according to claim 1 wherein the catalyst is contacted in step (a) with the reducing gas in a fixed or fluidized bed reactor or a slurry reactor.

16. A process for rejuvenating a partially deactivated catalyst which has been partially deactivated by contacting a suspension comprising the partially deactivated catalyst suspended in a liquid medium with a reducing gas in a reactor system comprising at least one high shear mixing zone and a reactor vessel wherein the process comprises:

a) passing the suspension through the high shear mixing zone(s) where the reducing gas is mixed with the suspension;

b) discharging a mixture comprising the reducing gas and the suspension from the high shear mixing zone(s) into the reactor vessel; and c) recycling the suspension to the high shear mixing zone(s).

17. A process according to claim 16 wherein the partially deactivated catalyst is rejuvenated by contacting the suspension sequentially with carbon monoxide and hydrogen.

18. A process according to claim 16 wherein the partially deactivated catalyst is contacted with the reducing gas at a temperature of 50–600° C.

19. A process according to claim 16 wherein the partially deactivated catalyst is contacted with the reducing gas at a pressure of 1–100 bar.

20. A process according to claim 1 wherein the reactor vessel is a tank reactor or a tubular loop reactor.

21. A process according to claim 1 wherein the high shear mixing zone(s) comprise an injector-mixing nozzle(s).

22. A process according to claim 1 wherein the injector mixing nozzle(s) is a venturi nozzle(s) or a gas blast nozzle (s).

23. A process according to claim 1 wherein the Fischer-Tropsch reaction is carried out at a temperature of 180–280° C. and at a pressure of 5–50 bar.

24. A process according to claim 1 wherein the ratio of hydrogen to carbon monoxide in the synthesis gas is in the range of 20:1 to 0.1:1 by volume.

25. A process according to claim 1 wherein catalyst comprises cobalt supported on an inorganic oxide.

26. A process according to claim 25 wherein the inorganic oxide is zinc oxide.

27. A process according to claim 25 wherein the catalyst comprises between 0.1–20 wt % of cobalt.

* * * * *